US005560127A

United States Patent [19]

Thomas

[11] Patent Number: 5,560,127

[45] Date of Patent: Oct. 1, 1996

[54] PERPETUAL CALENDAR

[76] Inventor: Robert J. Thomas, 3451 Academy, Dearborn, Mich. 48124-3325

[21] Appl. No.: 383,457

[22] Filed: Feb. 3, 1995

[51] Int. Cl.[6] ..... G09D 3/10

[52] U.S. Cl. ..... 40/118; 40/524

[58] Field of Search ..... 40/118, 524, 525

[56] References Cited

U.S. PATENT DOCUMENTS

| | | | |
|---|---|---|---|
| 323,939 | 8/1885 | Kletzker | 40/118 |
| 842,495 | 1/1907 | Rose | 40/524 |
| 3,201,882 | 8/1965 | Alford et al. | 40/524 |
| 3,427,740 | 2/1969 | Heskes | 40/109 |
| 3,800,454 | 4/1974 | Anderson | 40/109 |
| 4,075,774 | 2/1978 | Day | 40/109 |
| 4,251,935 | 2/1981 | Wright | 40/109 |
| 4,376,346 | 3/1983 | Nelson | 40/114 |

FOREIGN PATENT DOCUMENTS

| | | | |
|---|---|---|---|
| 1330255 | 3/1963 | France | 40/524 |
| 2397029 | 3/1979 | France | 40/118 |
| 624570 | 6/1949 | United Kingdom | 40/524 |

*Primary Examiner*—Kenneth J. Dorner
*Assistant Examiner*—Cassandra Davis
*Attorney, Agent, or Firm*—William R. Sharp

[57] ABSTRACT

A perpetual calendar is provided which employs movably mounted, elongated strips for displaying the days of the month and corresponding days of the week in a side by side relationship. A first strip has permanently affixed to its outer surface the numbers 1–31 representing days of the month, and a second strip has permanently affixed to its outer surface indicia representing days of the week. The relative positions of the first and second strips can be adjusted to positions appropriate for any month of any year. The calendar also preferably has a third strip having an indicator permanently affixed to its outer surface for indicating the current day of the month and corresponding day of the week.

14 Claims, 2 Drawing Sheets

PERPETUAL CALENDAR

BACKGROUND OF THE INVENTION

This invention relates to the field of perpetual calendars. Such calendars can be used in any particular year so as to not require the purchase of a new calendar every year.

Heretofore, perpetual calendars have either been complex in their construction and/or operation, or are highly difficult and confusing to read. Thus, prior art perpetual calendars having such deficiencies are of limited utility and practicality, and have accordingly not come into wide use by a time conscious public.

SUMMARY OF THE INVENTION

It is, therefore, an object of the invention to provide a perpetual calendar capable of displaying the days of the month and corresponding days of the week for any month of any year.

It is also an object of the invention that such perpetual calendar is desirably simple in its construction and operation.

It is yet another object of the invention that such perpetual calendar is easy to read insofar as only a brief glance of the calendar gives the user information regarding the day of the month and corresponding day of the week.

The above objects are realized by a perpetual calendar comprising: an elongated first strip having opposing surfaces and having permanently affixed to one such surface, hereafter denoted as a first imprinted surface, indicia (i.e. abbreviations) representing the days of the week which are arranged sequentially and longitudinally along the first imprinted surface; an elongated second strip having opposing surfaces and having permanently affixed to one such surface, hereafter denoted as a second imprinted surface, the numbers 1–31 representing the days of the month which are arranged in numerical sequence and longitudinally along the second imprinted surface, wherein the second imprinted surface is situated with respect to the first imprinted surface so as to be substantially coplanar therewith and so that indicia representing days of the week and numbers representing days of the month are in a side by side relationship; means upon which the first and second strips are movably mounted to allow each of the first and second strips to be moved longitudinally with respect to one another; whereby the relative positions of the first and second strips can be adjusted so that indicia representing days of the week and numbers representing days of the month are positioned beside one another in a manner appropriate for a particular month of any year.

According to a preferred embodiment, the perpetual calendar of the invention further comprises an elongated, movable third strip having an indicator which can be positioned along side a desired number and indicium to thereby indicate the current day of the month and corresponding day of the week. Such preferred embodiment also employs an elongated member as the "means" upon which the strips are movably mounted, where such strips are continuous and wrapped around opposing ends of the elongated member so that the other, nonimprinted surface of each strip is in sliding contact with such opposing ends upon movement of each such strip.

The perpetual calendar of the invention is, therefore, of desirably simple construction and operation, and can be easily read by a user. The user can simply move the first and second strips each month to positions appropriate for any month of any year, and can further move the third strip each day to indicate the current day of the month and corresponding day of the week.

DETAILED DESCRIPTION OF THE DRAWINGS

Figure 1:
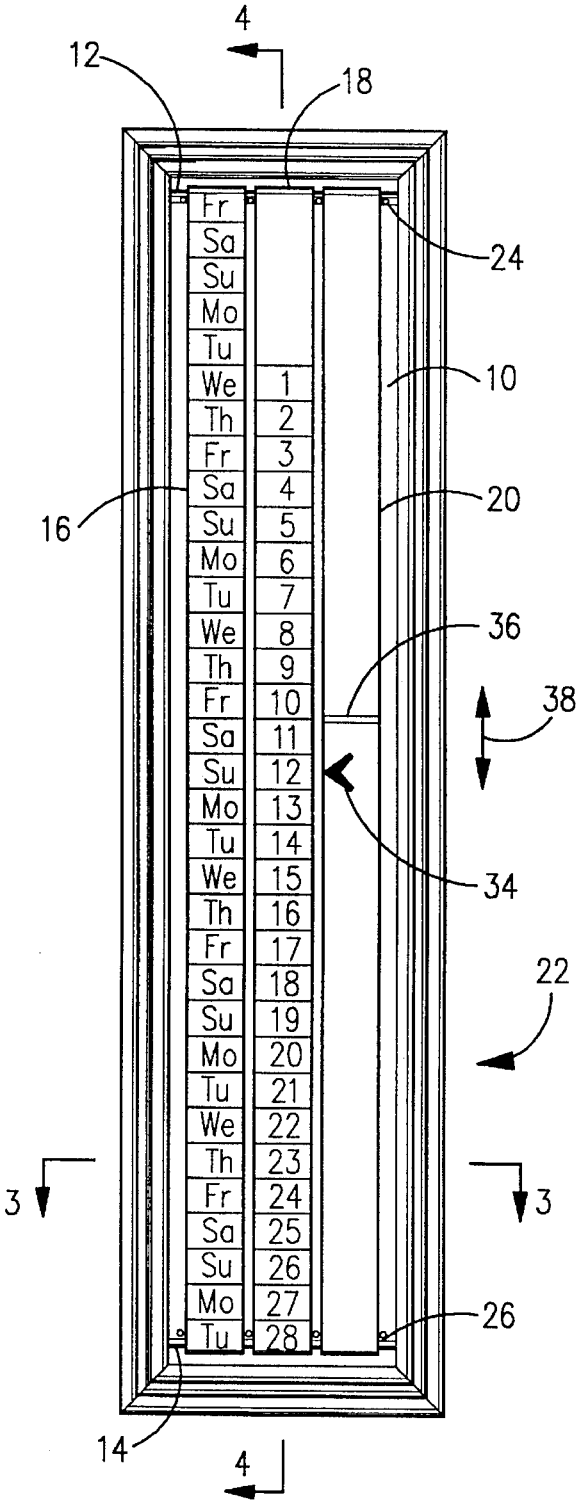
FIG. 1 is a front view of a perpetual calendar in accordance with the present invention, such calendar having continuous strips movable by means of associated tabs.
Figure 2:
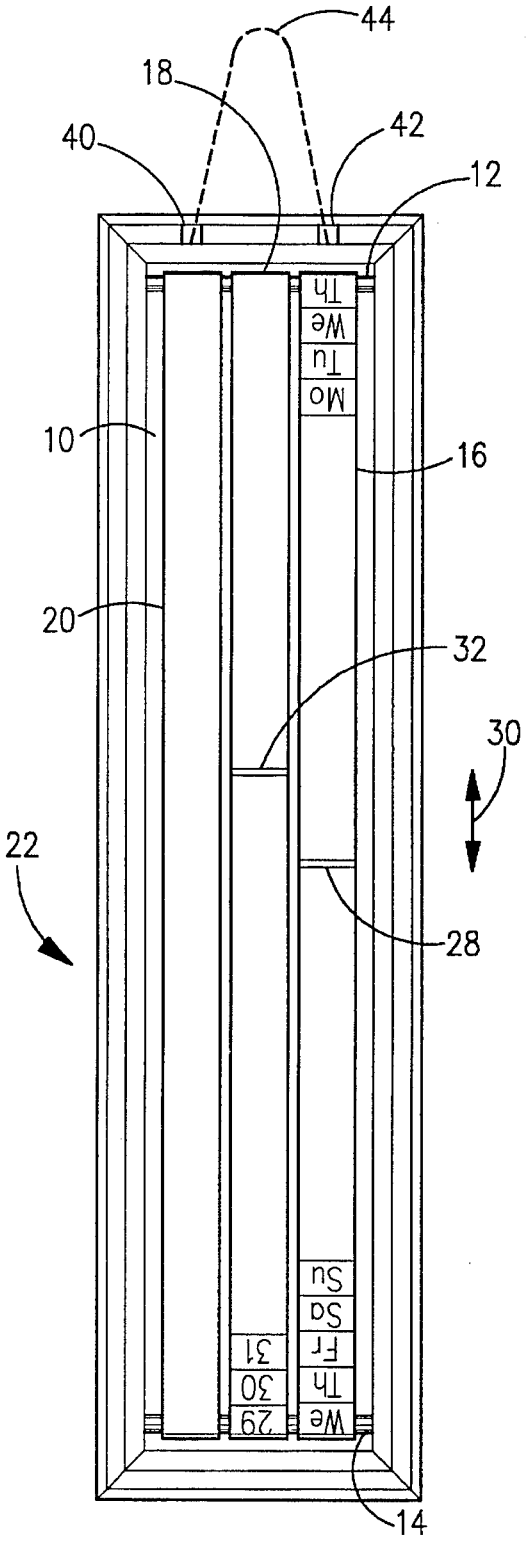
FIG. 2 is a rear view of the perpetual calendar shown in FIG. 1.
Figure 3:
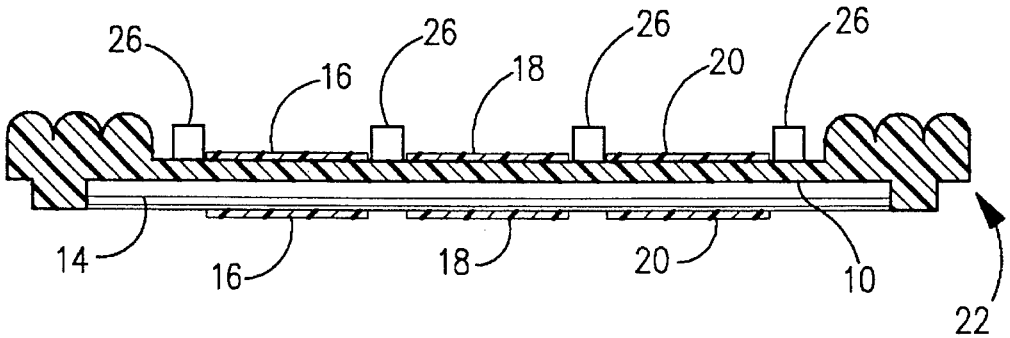
FIG. 3 is a cross-sectional view of the perpetual calendar of FIG. 1 as viewed along line 3—3.
Figure 4:
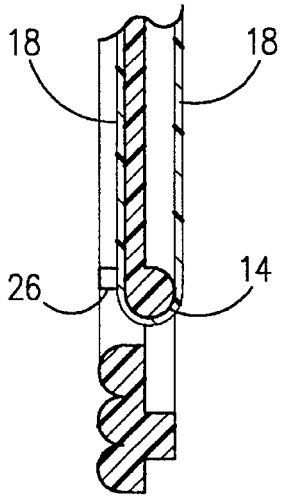
FIG. 4 is a cross-sectional view of the perpetual calendar of FIG. 1 as viewed along line 4—4 and with a middle portion of the calendar broken away.

Referring to FIGS. 1 and 2, such FIGURES respectively show front and rear views of a preferred embodiment of the invention. The illustrated perpetual calendar comprises an elongated member 10 (the structure of which is best shown in FIGS. 3 and 4) having opposing ends 12 and 14, an elongated strip 16 for displaying the days of the week, an elongated strip 18 for displaying the days of the month, an elongated strip 20 for indicating the current day of the month and corresponding day of the week, and a decorative frame 22 having end sections as well as side sections, such side sections being connected to, and preferbly integral with, elongated member 10 along its sides and at its ends 12 and 14. As shown, a space is defined between end 12 and the adjacent upper end section of frame 22, and a space is similarly defined between end 14 and the adjacent lower end section of frame 22. Each such space has a width sufficient to allow ease of passage therethrough by each strip. As is further explained below, each of strips 16, 18, and 20 is movably mounted upon elongated member 10 to allow such strips to be moved longitudinally and independently with respect to one another.

The front side of elongated member 10 is a generally planar surface which has extending therefrom a first set of four alignment pegs, such as shown at 24, near end 12, and a second set of four alignment pegs, such as shown at 26, near end 14. Such alignment pegs function to maintain the strips 16, 18, and 20 in their desired nonoverlapping, side by side relationship as shown. Elongated member 10 is preferably a rigid and opaque plastic integrally molded with at least the side sections of frame 22. It is particularly desirable that the surfaces of elongated member 10 (especially the front surface and ends) are smooth in texture to minimize frictional resistance to movement of the strips.

Each of strips 16, 18, and 20 has opposing inner and outer surfaces and is continuous so as to form a closed loop wrapped around ends 12 and 14. The front side of each such loop is shown in FIG. 1, whereas the back side is shown in FIG. 2.

Strip 16 has permanently affixed to its outer surface, such as by silk screen or offset printing, indicia representing the days of the week which are arranged sequentially and longitudinally along such imprinted outer surface. It can be seen from FIGS. 1 and 2 that most of the indicia are on the front side of the loop formed by strip 16, and the remaining indicia are on the back side of the loop. The indicia in the illustrated embodiment are abbreviations of the days of the week which are repeated six times in sequence. As shown in FIG. 2, the loop formed by strip 16 has a tab 28 extending from its back side for ease of manipulation by a user (with a finger) of the calendar in moving strip 16 vertically, as indicated at 30, to its desired position.

Strip 18 has permanently affixed to its outer surface, such as by silk screen or offset printing, the numbers 1–31 representing the days of the month which are arranged in numerical sequence and longitudinally along such imprinted outer surface. The calendar in FIGS. 1 and 2 is set for February of 1995 and therefore has the numbers 1–28 on the front side of the loop formed by strip 18, and the numbers 29–31 on the back side of the loop. It should be apparent, however, that strip 18 is positionable to have no numbers on the back side of the loop for months with 31 days, only the number 31 on the back side of the loop for months with 30 days, or the numbers 30 and 31 on the back side of the loop for the month of February in leap years. The imprinted outer surface of strip 18 is situated with respect to the imprinted outer surface of strip 16 so as to be substantially coplanar therewith and so that on the front, viewing side of the calendar the indicia representing days of the week and numbers representing days of the month are in a side by side relationship. As shown in FIG. 2, the loop formed by strip 18 has a tab 32 extending from its back side for manipulation by a user in moving strip 18 vertically, as also indicated at 30, to its desired position.

Strip 20 has permanently affixed to its outer surface an indicator 34 for indicating the current day of the month and corresponding day of the week. Indicator 34 can be printed on the outer surface of strip 20 by, for example, silk screen or offset printing, or it can be in the form of a three dimensional element suitably affixed to such outer surface, such as a piece of colored tape cut to the desired configuration. The imprinted outer surface of strip 20 is substantially coplanar with the imprinted outer surfaces of strips 16 and 18. As shown in FIG. 1, tab 36 extends from the front side of the loop formed by strip 20 for manipulation by a user to move strip 20 vertically, as indicated at 38, to a position at which indicator 34 is along side the number representing the current day of the month and the indicium representing the corresponding day of the week.

With respect to FIG. 2, the upper end section of frame 22 can have a suitable means for hanging the calendar from a wall such that strips 16, 18, and 20 are substantially vertically oriented. The calendar can be hung in a narrow wall space, preferably in a conspicuous location for ease of viewing. Slots 40 and 42 are provided in the illustrated embodiment in which the ends of a hanging cord, shown by a broken line at 44, can be permanently mounted.

Each of strips 16, 18, and 20 preferably comprises a suitably flexible plastic, such as Mylar® plastic film, with a glossy inner surface to minimize friction and a matte outer surface to optimally receive printed images. The thickness of each of the strips is preferably in the range of about 2≧4 mils, and most preferably about 3 mils. It has been found that such thickness provides the desired flexibility and also does not crease when a strip is left in a particular position for a period of time. The strips are shown in the FIGURES (particularly FIGS. 3–6) with thicknesses greater than the above-mentioned preferred thicknesses for ease of illustration.

Referring now to FIG. 3, this transverse cross-sectional view of the calendar illustrated in FIGS. 1 and 2 shows in cross section elongated member 10 between its ends, the two side sctions of frame 22, and each of strips 16, 18, and 20. Reference numbers 16, 18, and 20 designate respective strips on the front and back sides of the loops formed by such strips. Also shown in FIG. 3 are each of alignment pegs 26 and end 14 of elongated member 10.

Referring now to FIG. 4, this longitudinal cross-sectional view of the calendar illustrated in FIGS. 1 and 2 shows in cross section elongated member 10, the end sections of frame 22, and strip 18. Also shown in FIG. 4 is an alignment peg 24 and an alignment peg 26. In particular, this FIGURE clearly shows the manner in which a strip is wrapped around the opposing ends 12 and 14 of elongated member 10 so that the nonimprinted, inner surface of such strip is in sliding contact with such ends, as well as the front surface of elongated member 10, upon movement of the strip. To minimize friction in such sliding contact, ends 12 and 14 are shown as being rounded.

Figure 5:
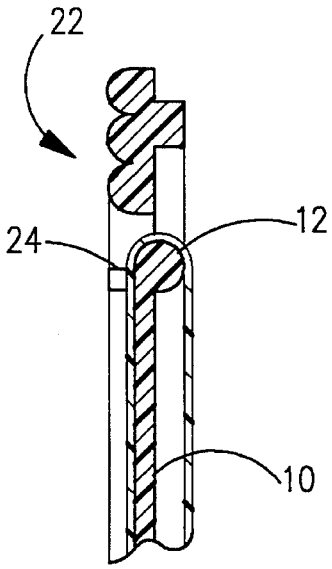
FIG. 5 illustrates one manner of forming a tab for a strip.
Figure 5:
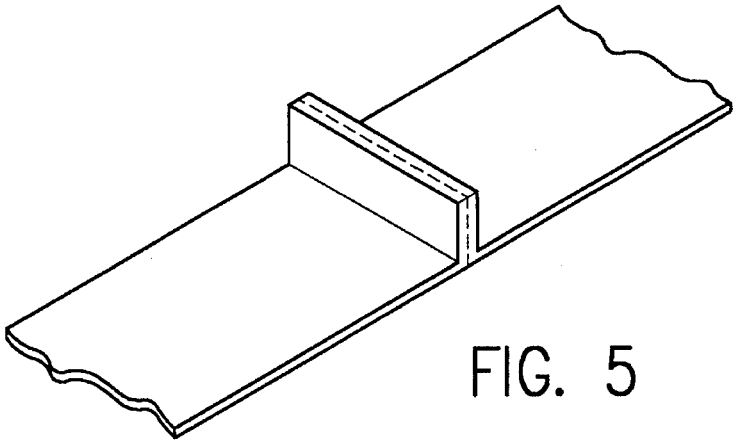
Figure 6:
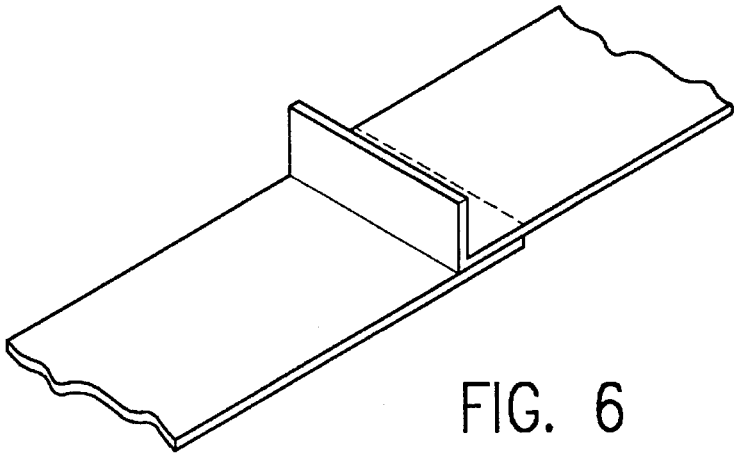
FIG. 6 illustrates another manner of forming a tab for a strip.

Each of tabs 28, 32, and 36 can be formed in any suitable manner to permit easy manipulation of its respective strip. Referring now to FIG. 5, one manner of forming a tab is shown, wherein end portions of the strip are folded and connected (shown by broken lines) by suitable means, such as an adhesive or staple(s). Referring now to FIG. 6, there is shown another manner of forming a tab, wherein end portions of a strip are overlapped and connected by an adhesive, and further wherein only one end portion is folded to form the tab. In either of FIGS. 5 and 6, a piece of splicing tape can be employed at the connection between end portions of a strip to reinforce the connection.

To use the illustrated and above described calendar, the user moves strip 20 with tab 36 each day to indicate the current day of the month and corresponding day of the week. Each month, the user turns the calendar over and moves strips 16 and 18 with respective tabs 28 and 32 to positions appropriate for any month of any year. The calendar is then placed back in its normal viewing position.

Thus, there is provided by the present invention a perpetual calendar that can be used for any month of any year, is desirably simple in its construction and operation, and is very easy to read.

Obviously, many modifications and variations of the present invention are possible in light of the above teachings. It is, therefore, to be understood that within the scope of the appended claims, the invention may be practiced otherwise than as specifically described.

That which is claimed is:

1. A perpetual calendar comprising:

an elongated first strip having opposing surfaces and having permanently affixed to one such surface, hereafter denoted as a first imprinted surface, indicia representing the days of the week which are arranged sequentially and longitudinally along the first imprinted surface, wherein the first strip is continuous and forms a closed loop having a front side, for viewing, and a back side;

an elongated second strip having opposing surfaces and having permanently affixed to one such surface, hereafter denoted as a second imprinted surface, the numbers 1–31 representing the days of the month which are arranged in numerical sequence and longitudinally along the second imprinted surface, wherein the second imprinted surface is situated with respect to the first imprinted surface so as to be substantially coplanar therewith and so that indicia representing days of the week and numbers representing days of the month are in a side by side relationship, and wherein the second strip is continuous and forms a closed loop having a front side, for viewing, and a back side;

means upon which the first and second strips are movably mounted to allow each of the first and second strips to be moved longitudinally with respect to one another, wherein the first strip is positionable so that some indicia are on the front side and the remainder of the indicia are on the back side, and wherein the second strip is selectively positionable in one of a first position where all numbers 1–31 are on the front side, a second position where numbers 1–28 are on the front side and 29–31 are on the back side, a third position where numbers 1–29 are on the front side and 30–31 are on the back side, and a fourth position where numbers 1–30 are on the front side and 31 is on the back side;

whereby the relative positions of the first and second strips can be adjusted so that indicia representing days of the week and numbers representing days of the month are positioned beside one another in a manner appropriate for a particular month of any year.

2. A perpetual calendar as recited in claim 1 further comprising an elongated third strip which is continuous and forms a closed loop having a front side, for viewing, and a back side, the third strip being movably mounted upon said means and having opposing surfaces, wherein one such surface, denoted as a third imprinted surface, is substantially coplanar with the first and second imprinted surfaces and has permanently affixed thereto an indicator which can be moved with respect to the first and second strips so as to be positioned along side the desired indicium and number respectively representing the day of the week and day of the month.

3. A perpetual calendar as recited in claim 2 wherein said means comprises an elongated member having opposing ends around which each continuous strip is wrapped so that the other, nonimprinted surface of each such strip, upon movement thereof, is in sliding contact around such opposing ends.

4. A perpetual calendar as recited in claim 3 wherein the elongated member has an alignment peg means near each end thereof which comprises a plurality of alignment pegs projecting therefrom for maintaining the first, second, and third continuous strips in their desired nonoverlapping, side by side relationship during movement of such continuous strips.

5. A perpetual calendar as recited in claim 4 wherein the ends of the elongated member are rounded to minimize friction in said sliding contact.

6. A perpetual calendar as recited in claim 5 wherein each continuous strip comprises a plastic material.

7. A perpetual calendar as recited in claim 6 wherein the indicia on the first strip represent the days of the week as repeated six times in sequence.

8. A perpetual calendar as recited in claim 7 wherein each loop so formed by each continuous strip has a tab extending therefrom for ease of manipulation by a user of the calendar in moving each such strip to a desired position.

9. A perpetual calendar as recited in claim 8 further comprising a means for hanging the calendar from a wall such that the first, second, and third continuous strips are substantially vertically oriented.

10. A perpetual calendar comprising:

an elongated first strip having opposing surfaces and having permanently affixed to one such surface, hereafter denoted as a first imprinted surface, indicia representing the days of the week which are arranged sequentially and longitudinally along the first imprinted surface, wherein the first strip is continuous and forms a closed loop having a first tab extending therefrom;

an elongated second strip having opposing surfaces and having permanently affixed to one such surface, hereafter denoted as a second imprinted surface, the numbers 1–31 representing the days of the month which are arranged in numerical sequence and longitudinally along the second imprinted surface, wherein the second imprinted surface is situated with respect to the first imprinted surface so as to be substantially coplanar therewith and so that indicia representing days of the week and numbers representing days of the month are in a side by side relationship, and wherein the second strip is continuous and forms a closed loop having a second tab extending therefrom;

an elongated third strip having opposing surfaces of which one such surface, denoted as a third imprinted surface, is substantially coplanar with the first and second imprinted surfaces and has permanently affixed thereto an indicator, wherein the third strip is continuous and forms a closed loop having a third tab extending therefrom;

means upon which the first, second, and third strips are movably mounted to allow each of the first, second, and third strips to be moved longitudinally and independently with respect to one another by means of manipulation of the first, second, and third tabs;

whereby the relative positions of the first, second, and third strips can be adjusted so that indicia representing days of the week and numbers representing days of the month are positioned beside one another in a manner appropriate for a particular month of any year, and so that the indicator is positioned along side the desired indicium and number respectively representing the day of the week and day of the month.

11. A perpetual calendar as recited in claim 10 wherein the closed loop formed by each strip has a front side, for viewing, and a back side, and wherein the first strip is positionable so that some indicia are on the front side and the remainder of the indicia are on the back side, and further wherein the second strip is selectively positionable in one of a first position where all numbers 1–31 are on the front side, a second position where numbers 1–28 are on the front side and 29–31 are on the back side, a third position where numbers 1–29 are on the front side and 30–31 are on the back side, and a fourth position where numbers 1–30 are on the front side and 31 is on the back side.

12. A perpetual calendar comprising:

an elongated first strip having opposing surfaces and having permanently affixed to one such surface, hereafter denoted as a first imprinted surface, indicia representing the days of the week which are arranged sequentially and longitudinally along the first imprinted surface, wherein the first strip is comprised of a flexible, plastic material and is continuous so as to form a closed loop having a front side, for viewing, and a back side from which a first tab extends;

an elongated second strip having opposing surfaces and having permanently affixed to one such surface, hereafter denoted as a second imprinted surface, the numbers 1–31 representing the days of the month which are arranged in numerical sequence and longitudinally along the second imprinted surface, wherein the second imprinted surface is situated with respect to the first imprinted surface so as to be substantially coplanar therewith and so that indicia representing days of the week and numbers representing days of the month are in a side by side relationship, and wherein the second strip is comprised of a flexible, plastic material and is continuous so as to form a closed loop having a front side, for viewing, and a back side from which a second tab extends;

an elongated member having rounded opposing ends around which the first and second strips are wrapped to allow each of the first and second strips to be moved longitudinally with respect to one another so that the other, nonimprinted surface of each strip, upon movement thereof, is in sliding contact with the opposing ends, wherein the first strip is positionable so that some indicia are on the front side and the remainder of the indicia are on the back side, and wherein the second strip is selectively positionable in one of a first position where all numbers 1–31 are on the front side, a second position where numbers 1–28 are on the front side and 29–31 are on the back side, a third position where numbers 1–29 are on the front side and 30–31 are on the back side, and a fourth position where numbers 1–30 are on the front side and 31 is on the back side;

whereby the relative positions of the first and second strips can be adjusted by means of manipulation of the first and second tabs so that indicia representing days of the week and numbers representing days of the month are positioned beside one another in a manner appropriate for a particular month of any year.

13. A perpetual calendar as recited in claim 12 further comprising an elongated third strip wrapped around the opposing ends of the elongated member and having opposing surfaces of which one such surface, denoted as a third imprinted surface, is substantially coplanar with the first and second imprinted surfaces and has permanently affixed thereto an indicator, wherein the other, nonimprinted surface of the third strip, upon movement thereof, is in sliding contact with the opposing ends, and wherein the third strip is comprised of a flexible plastic material and is continuous so as to form a closed loop having a front side, for viewing, and a back side, a third tab extending from the front side which can be manipulated to move the third strip longitudinally with respect to the first and second strips so that the indicator is positioned along side the desired indicium and number respectively representing the day of the week and day of the month.

14. A perpetual calendar as recited in claim 13 wherein the elongated member has an alignment peg means near each end thereof which comprises a plurality of alignment pegs projecting therefrom for maintaining the first, second, and third strips in their desired nonoverlapping, side by side relationship during movement of such strips.

* * * * *